US005812156A

United States Patent [19]

Bullock et al.

[11] Patent Number: 5,812,156

[45] Date of Patent: Sep. 22, 1998

[54] APPARATUS CONTROLLED BY DATA FROM CONSUMABLE PARTS WITH INCORPORATED MEMORY DEVICES

[75] Inventors: Michael L. Bullock; Winthrop D. Childers, both of San Diego, Calif.

[73] Assignee: Hewlett-Packard Company, Palo Alto, Calif.

[21] Appl. No.: 785,580

[22] Filed: Jan. 21, 1997

[51] Int. Cl.[6] ..... B41J 29/393

[52] U.S. Cl. ..... 347/19; 347/14

[58] Field of Search ..... 347/17, 14, 7, 347/19

[56] References Cited

U.S. PATENT DOCUMENTS

| | | | |
|---|---|---|---|
| 4,551,000 | 11/1985 | Kanemitsu et al. | 355/3 R |
| 4,748,453 | 5/1988 | Lin et al. | 346/1.1 |
| 4,803,521 | 2/1989 | Honda | 355/14 R |
| 4,943,813 | 7/1990 | Palmer | 346/1.1 |
| 4,961,088 | 10/1990 | Gilliland et al. | 395/206 |
| 5,021,828 | 6/1991 | Yamaguchi et al. | 355/209 |
| 5,049,898 | 9/1991 | Arthur | 346/1.1 |
| 5,132,711 | 7/1992 | Shinada et al. | 346/140 R |
| 5,138,344 | 8/1992 | Ujita | 346/140 R |
| 5,184,181 | 2/1993 | Kurando et al. | 355/260 |
| 5,272,503 | 12/1993 | LeSueur et al. | 355/208 |
| 5,365,312 | 11/1994 | Hillmann et al. | 355/206 |
| 5,410,641 | 4/1995 | Wakabayashi et al. | 395/112 |
| 5,506,611 | 4/1996 | Ujita et al. | 347/86 |
| 5,587,728 | 12/1996 | Edgar | 347/19 |
| 5,610,635 | 3/1997 | Murray et al. | 347/7 |
| 5,633,670 | 5/1997 | Kwak | 347/188 |

FOREIGN PATENT DOCUMENTS

0720916A2 7/1996 European Pat. Off. .

OTHER PUBLICATIONS

Xerox Disclosure Journal, vol. 8, No. 6, Nov./Dec. 1983, p. 503, R. A. Lonis, "Storage of Operating Parameters in Memory Integral with Printhead".

*Primary Examiner*—Edgar S. Burr
*Assistant Examiner*—Dave A. Ghatt

[57] ABSTRACT

A printing system includes a replaceable cartridge for housing a supply of consumable marking media. The cartridge includes a cartridge memory for recording printing system-related parameters, including marking media parameters. A replaceable printing device, such as an ink jet head, includes a printhead memory for recording printing device-related parameters. A processor is coupled to the cartridge memory, the printhead memory and is responsive to parameters read from both memories to derive printing system function control values that are dependent upon one or more marking media parameters from the cartridge memory and one or more parameters from the printhead memory. The processor is thus able (in the case of an ink jet printing system) to determine a current ink supply value from a cumulative usage value stored on the cartridge memory and a drop volume parameter stored on the printhead memory. Further, a drop volume parameter stored on the printhead memory can be adjusted to accommodate a media type sensed by a media sensor.

24 Claims, 5 Drawing Sheets

APPARATUS CONTROLLED BY DATA FROM CONSUMABLE PARTS WITH INCORPORATED MEMORY DEVICES

FIELD OF THE INVENTION

This invention relates to apparatus that employs replaceable, consumable parts and, more particularly, to consumable parts which include integral memory for storing usage, calibration and other data that is used by a controlling processor to operate the apparatus.

BACKGROUND OF THE INVENTION

Substantially, all present-day copiers, printers, plotters, etc., include a controlling microprocessor which requires input calibration data to assure high quality production of documents. Since most such apparatus allows user-replacement of consumable items, various techniques have been developed to enable entry of usage, calibration and other data.

In regards to ink jet printers, it has been proposed that print heads incorporate a parameter memory for storage of operating parameters such as: drop generator driver frequency, ink pressure and drop charging values (see "Storage of Operating Parameters in Memory Integral with Print Head", Lonis, Xerox Disclosure Journal, Volume 8, No. 6, November/December 1983, page 503). U.S. Pat. No. 5,138,344 to Ujita, entitled "Ink Jet Apparatus and Ink Jet Cartridge Therefor", indicates that an ink-containing replaceable cartridge can be provided with an integral information device (i.e., a resistor element, magnetic medium, bar code, integrated circuit or ROM), for storage of information relating to control parameters for the ink jet printer.

U.S. Pat. No. 5,365,312 to Hillmann et al., entitled "Arrangement for Printer Equipment Monitoring Reservoirs that Contain Printing Medium", describes the use of memory devices integral with the ink reservoirs which store ink consumption data (for use by a coupled ink jet printer). European patent EP 0 720 916, entitled "Ink Supply Identification System for a Printer" describes the use of an ink supply having an integral EEPROM which is utilized to store data regarding the identity of the ink supply and its fill level.

The prior art further teaches the use of consumable parts with integral memory for use in electrophotographic printers. In U.S. Pat. No. 5,021,828 to Yamaguchi et al., entitled "Copying Apparatus having a Consumable Part", a toner cartridge is disclosed which includes a memory for storing data regarding to the state of consumption of toner in the cartridge. U.S. Pat. Nos. 4,961,088 to Gilliland et al.; 4,803,521 to Honda; 5,184,181 to Kurando et al.; and 5,272,503 to LeSueur et al. all describe various replaceable toner cartridges for use in electrophotographic printers. Each cartridge incorporates a memory device for storing parameter data regarding the cartridge.

Ink jet and laser printers have, in recent years, become more sophisticated in their operational and control functionalities. For instance, many such printers exhibit resolutions at levels of 600 dots per inch (dpi), double the previous printer generation resolution of 300 dpi. At such higher resolutions, misadjustments which were not visible at lower resolution levels become highly visible. Further, such printers are now being applied to generation of grey-scale images on media, requiring precise density and tonal control of the deposited ink/toner.

Thus, while it has been known that changes in functionality of various elements of a printer interact to affect print quality, many of those interactions could be ignored in the lower resolution printers. However, with performance improvements of new printer designs, such interactions must now be taken into account and compensated to assure high quality print documents.

Accordingly, it is an object of this invention to provide a print apparatus with an improved capability for adjustment of printer control functions.

It is another object of this invention to provide an improved printer control system which is able to update control parameters that are dependent upon current printer performance parameters contained on plural consumable parts.

It is yet another object of this invention to provide an improved ink jet printer which incorporates real time print control functions that are responsive to parameters read from plural consumable parts.

SUMMARY OF THE INVENTION

A printer includes a replaceable cartridge for housing a supply of consumable marking media. The cartridge includes a cartridge memory for recording printer-related parameters, including marking media parameters. A replaceable printing device, such as an ink jet head, includes a printhead memory for recording printing device-related parameters. A processor is coupled to the cartridge memory, the printhead memory and is responsive to parameters read from both memories to derive printer function control values that are dependent upon one or more marking media parameters from the cartridge memory and one or more parameters from the printhead memory. The processor is thus able (in the case of an ink jet printer) to determine a current ink supply value from a cumulative usage value stored on the cartridge memory and a drop volume parameter stored on the printhead memory. Further, a drop volume parameter stored on the printhead memory can be adjusted to accommodate a media type sensed by a media sensor.

DETAILED DESCRIPTION OF THE INVENTION

Figure 1A:
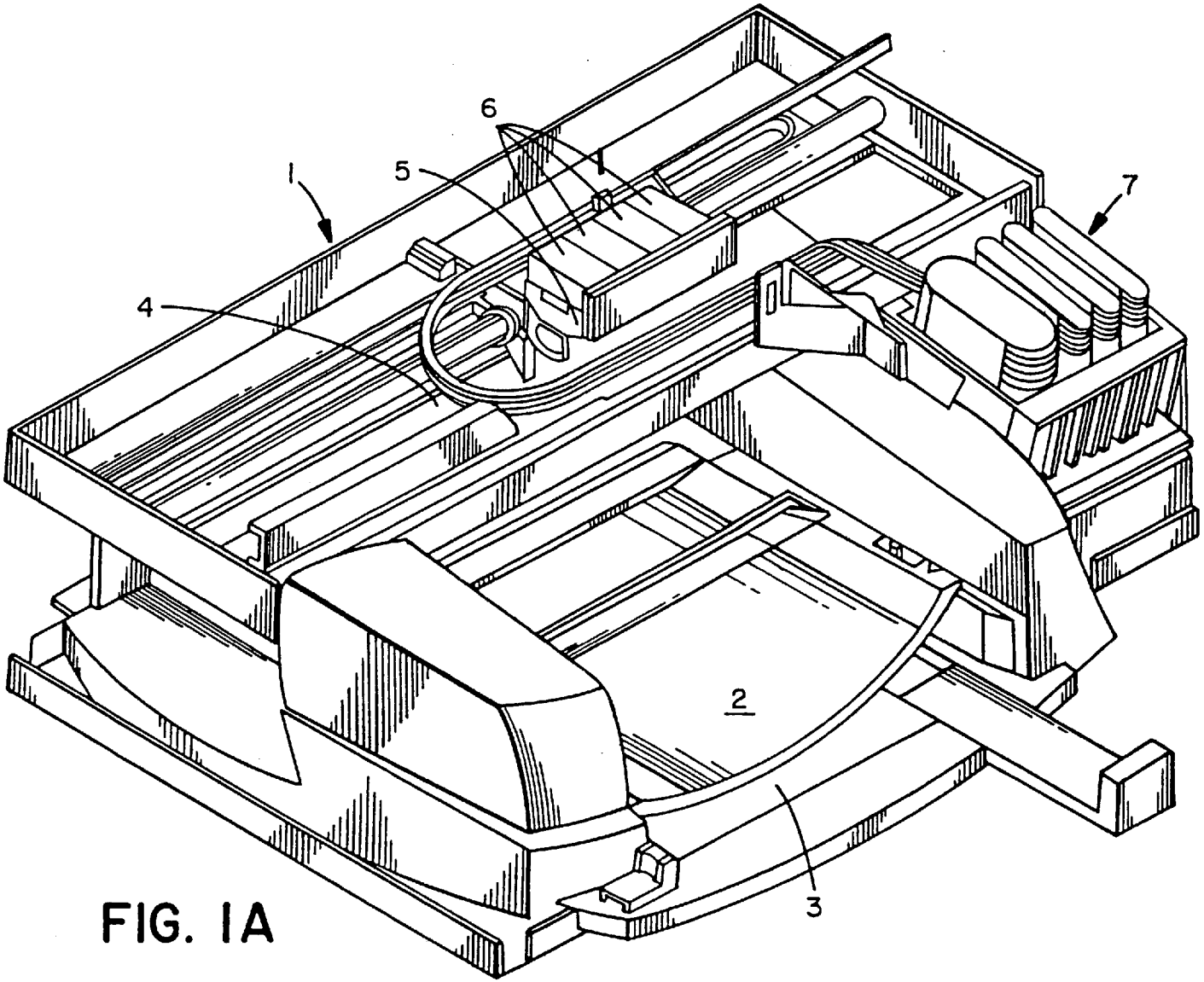
FIG. 1*a* is a perspective view of an ink jet printer (with cover removed), which incorporates the invention.

FIG. 1*a* illustrates a perspective view of an ink jet printer 1 incorporating the invention. A tray 2 holds a supply of input paper or other print media. When a printing operation is initiated, a sheet of paper is fed into printer 1 and is then brought around in a U direction towards an output tray 3. The sheet is stopped in a print zone 4 and a scanning carriage 5, containing plural, removable color printheads 6, is scanned across the sheet for printing a swath of ink thereon. The process repeats until the entire sheet has been printed, at which point, it is ejected onto output tray 3.

Printheads 6 are, respectively, fluidically coupled to four removable ink cartridges 7 holding Cyan, Magenta, Yellow and Black inks. Since black ink tends to be depleted most rapidly, the black ink cartridge has a larger capacity than the other cartridges. As will be understood from the description which follows, each printhead and ink cartridge is provided with an integral memory device which stores data that is used by printer 1 to control its printing operations.

Figure 1B:
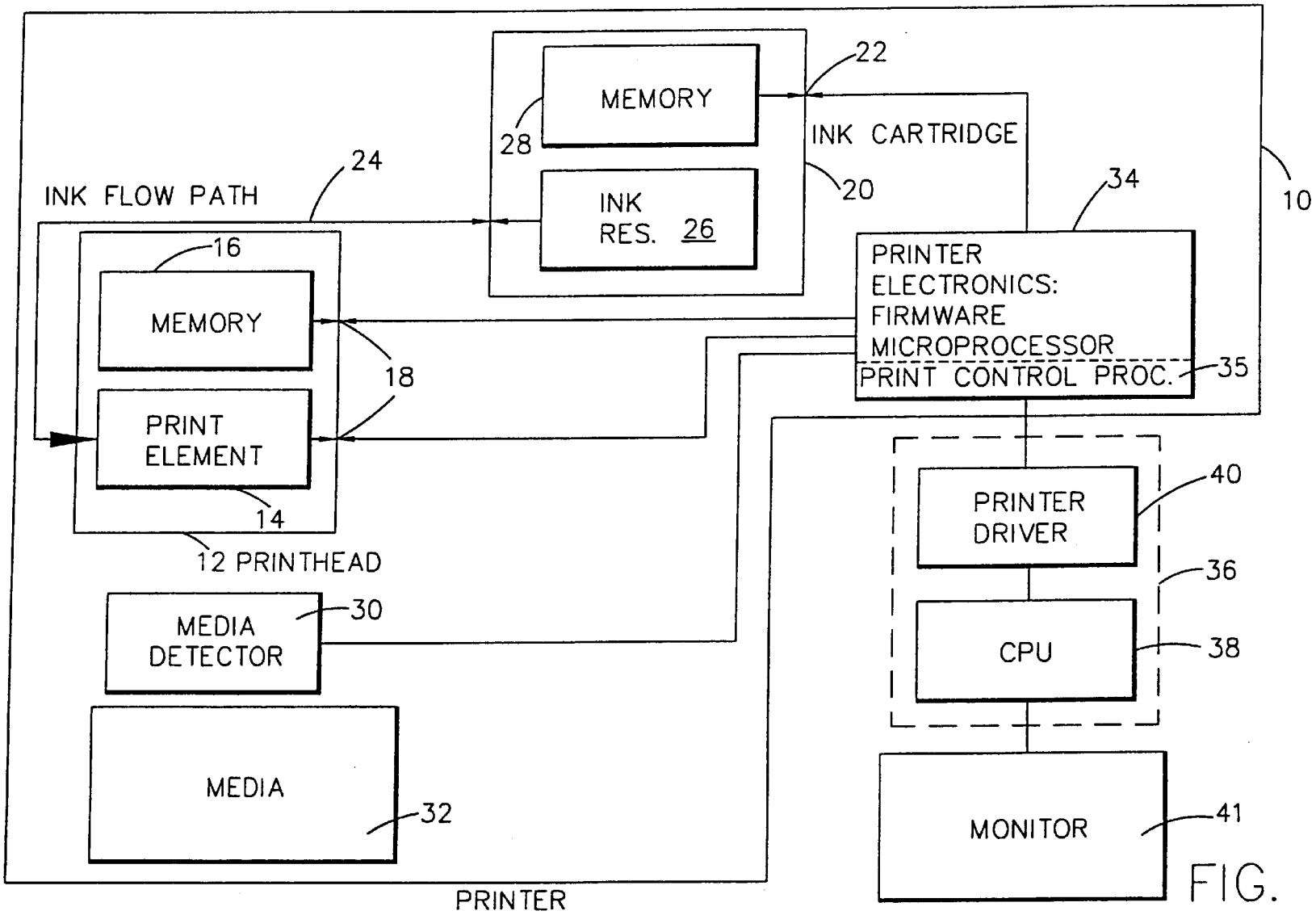
FIG. 1*b* is a block diagram of components of the ink jet printer of FIG. 1*a*.

FIG. 1*b* illustrates a block diagram of elements of the ink jet printer of FIG. 1*a*. Ink jet printer 1 includes a pluggable printhead 12 which includes a print element 14 and an integrally mounted printhead memory 16. Printhead 12 is pluggably removable from printer 1 via interconnects 18. An ink cartridge 20 is also pluggably removable from printer 1 via electrical interconnect 22 and fluidic interconnect 24. Ink cartridge 20 includes an ink reservoir 26 and an integral cartridge memory 28. The contents of memories 16 and 28 will be considered in detail below and, as will be understood, are instrumental in enabling real time control of ink jet printer 1 to produce high quality printed media.

A media detector 30 is positioned to scan an incoming media sheet 32 and determine from characteristics thereof, the specific type of media sheet which is being presented to printhead 12 for printing. Media sheet 32 may carry indicia that is only visible to media detector 30 (e.g., via an infra-red scan) or other indicia indicative of the media type.

Ink cartridge 20, printhead 12 and media detector 30 are interconnected to a microprocessor 34 which includes both electronics and firmware for the control of the various printer sub-assemblies. A print control procedure 35, which may be incorporated in the printer driver, causes the reading of data from cartridge memory 28 and printhead memory 16 and adjusts printer control parameters in accordance with parameter re-calculations based upon the data accessed from both memories.

A host processor 36 is connected to microprocessor 34 and includes a central processing unit (CPU) 38 and a software printer driver 40. A monitor 41 is connected to host processor 36 and is used to display various messages that are indicative of the state of ink jet printer 1.

Figure 3:
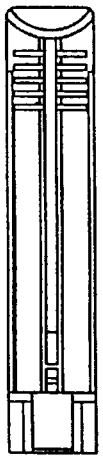
FIG. 3 is a side view of the ink cartridge of FIG. 2.
Figure 2:
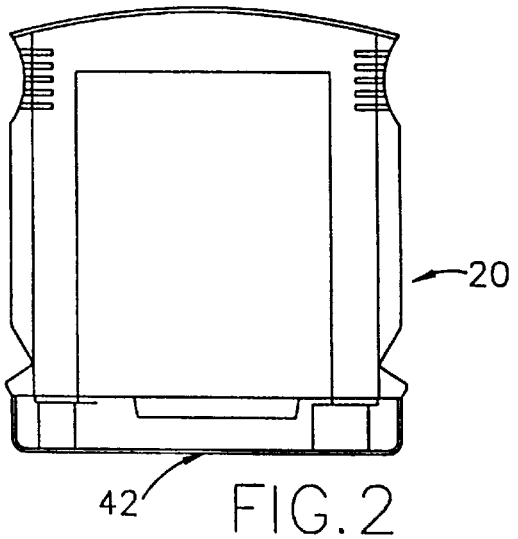
FIG. 2 is a frontal view of an ink-containing cartridge usable in the ink jet printer shown in FIG. 1.
Figure 4:
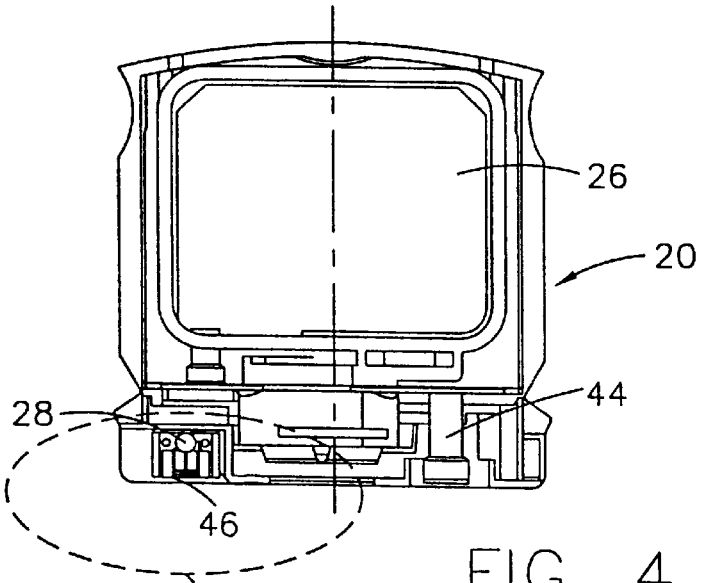
FIG. 4 is a schematic sectional view of the ink cartridge of a FIG. 2.

FIG. 2 illustrates a frontal view of ink cartridge 20 and FIG. 3, a side view thereof. Ink cartridge 20 is pluggable into a receptacle (not shown) in ink jet printer 1 and includes both a fluidic interconnection and an electrical interconnection, both of which are accessible through bottom surface 42. FIG. 4 shows a section of ink cartridge 20 and illustrates the positioning of ink reservoir 26, a fluidic connector 44 and an electrical connector 46. Electrical connector 46 enables interconnection to a cartridge memory chip 20.

Figure 4A:
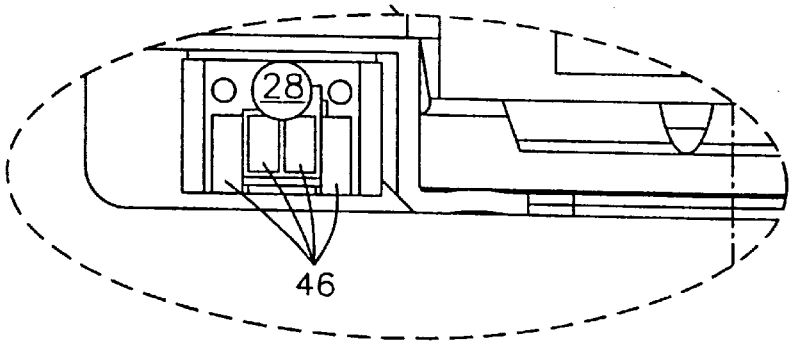
FIG. 4*a* is an expanded view of FIG. 4, showing details of a cartridge memory installed on the ink cartridge.

An expanded view of connector 46 and memory chip 20 are shown in FIG. 4*a*, with connector 46 making contact to a mating connector in the receptacle within ink jet printer 1 when ink jet cartridge 20 is pluggably inserted thereinto.

Figure 5:
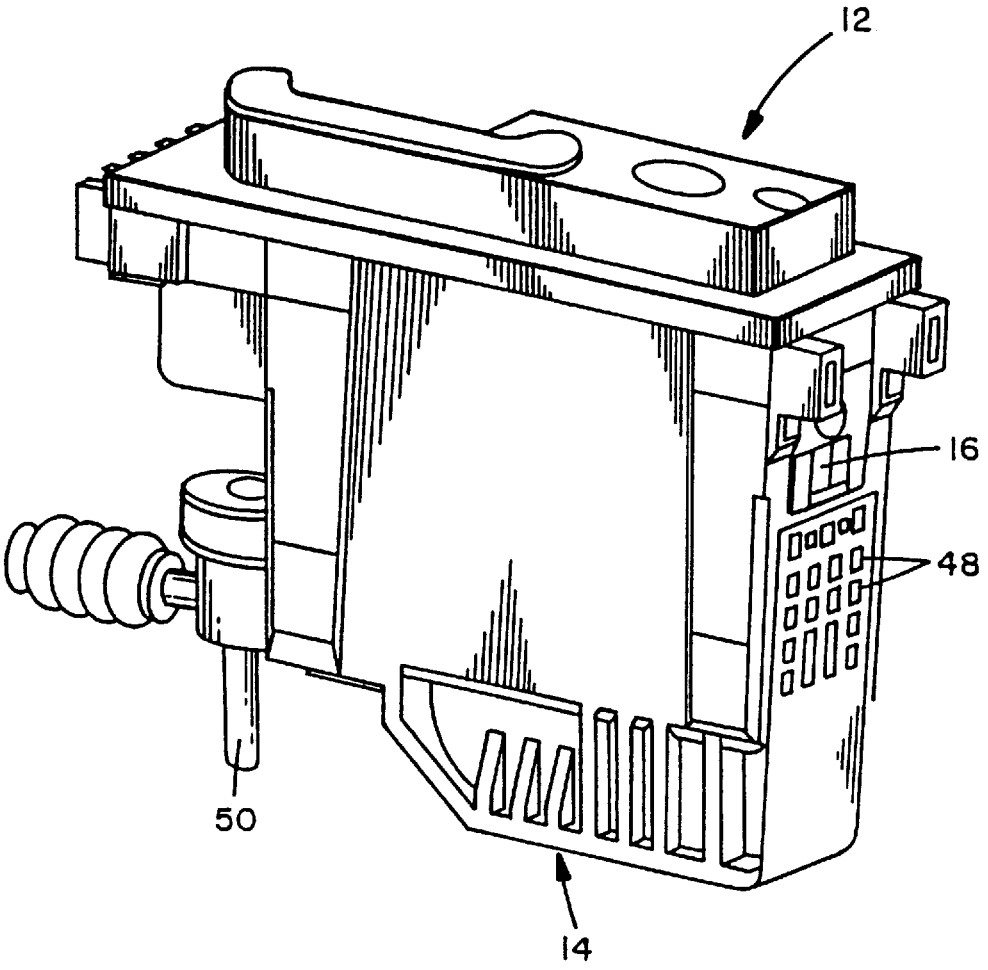
FIG. 5 is a perspective view of an ink jet printhead employed with the invention hereof.

FIG. 5 is a perspective view of printhead 12 and illustrates the placement of printhead memory 16 thereon. A plurality of contacts 48 enable pluggable interconnection to printhead memory 16 as well as various electrical elements within printhead 12. Printhead 12 is a known, thermally-actuated ink jet printhead, with a print element (including an orifice plate) positioned at surface 14. Behind each orifice is an ink chamber with a heater resistor. A thermal sense resistor is positioned on the printhead and detects the temperature of the semiconductor substrate on which the heater resistors are positioned. A fluidic interconnect 50 connects ink cartridge 12, via ink flow path 24 (see FIG. 1), to ink reservoir 26 in ink cartridge 20. When printhead 12 is plugged into a receptacle (not shown) within ink jet printer 1, contacts 48 make electrical connection to a mating connector in the printer and fluidic interconnect 50 automatically mates to ink flow path 24 to enable a flow of ink thereto.

As indicated above, cartridge memory 28 and printhead memory 16 enable microprocessor 34 to calculate control values which enable printer 1 to maintain high quality print media output. Data from media detector 30 is also employed for certain aspects of print media quality enhancement. To accomplish control of printer parameters, each of memories 16 and 28 includes both factory-written data and printer-recorded data. While not complete, the following is a list of data values stored within the aforesaid memories:

Cartridge memory 16
- Factory-written data:
  - Product tag
  - Supply size
  - Color map coefficients
  - Ink colorimetry
  - Color code
  - Dry time coefficient
  - Printer driver revision number
  - Printer driver revision parameters
  - Re-order part number
  - Manufacture day
  - Manufacture year
  - Freshness date
  - Ink shelf life
  - Serial number
  - Print mode coefficients
  - Outgas rate data for ink
- Printer written data:
  - Coarse count
  - Fine count
  - First insertion date
  - Last usage date
  - In-use time Printhead memory 16
- Factory recorded data:
  - Product tag
  - Drop volume measurement
  - Drop volume coefficients
  - Manufacture year
  - Manufacture day
  - Freshness date
  - Temperature sense resistor calibration data
  - Printhead alignment coefficients
  - Firing energy parameters
  - Print mode coefficients
  - Re-order part number
  - Driver version number
- Printer-recorded data:

Number of drops fired
First insertion date
Last usage date
In-use time
Number of pages printed.

As will be hereafter understood, print control procedure 35 makes use of the above-indicated parameters stored in memories 16 and 28 to control the operation and print quality of media output from ink jet printer 1. In a number of instances, data from both memories 16 and 28 are utilized to arrive at an improved control parameter. Further, the ability to periodically replace memories 16 and 28, as their host carriers (e.g., printhead 12 or ink cartridge 20) are replaced, enables the manufacturer to provide updated parameters, on a continuing basis, to customers who already have installed printers.

Figure 6:
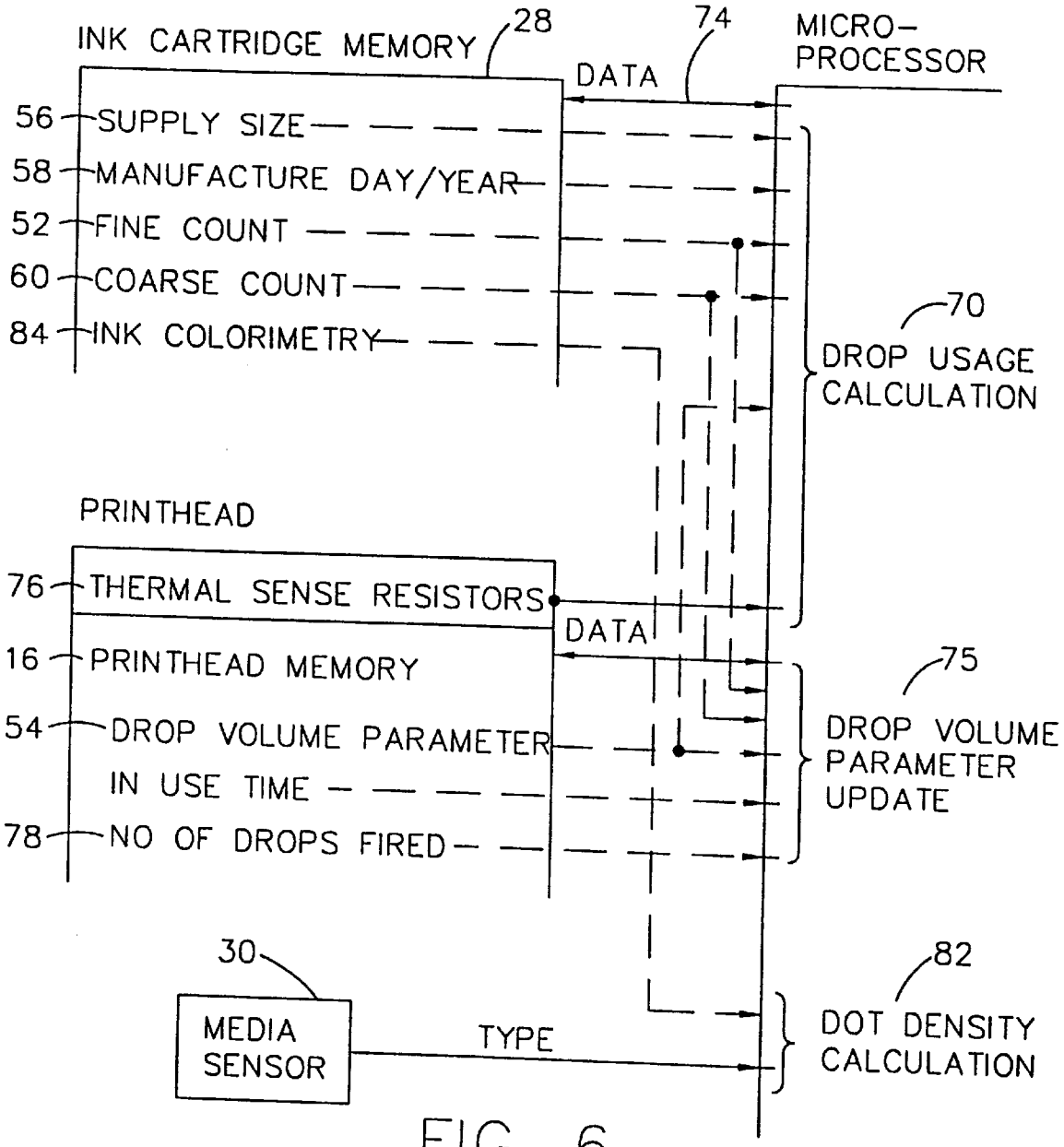
FIG. 6 is a schematic diagram indicating certain data stored in the cartridge memory contained on the ink cartridge of FIG. 2 and the printhead memory stored on the printhead of FIG. 5, and illustrating the usage of such data in deciding printer control values.

Turning to FIG. 6, subprocedures incorporated into print control procedure 35 will be described which utilize data from both printhead memory 16 and cartridge memory 28 and, in some cases, an input from media sensor 30. Before describing the subprocedures, it is worthwhile to consider certain details of the data stored in printhead memory 16 and cartridge memory 28.

A fine count value 52 stored in cartridge memory 28 is an 8-bit (for example) re-writable value, with each bit corresponding to 1/256 of 12.5% of the total supply volume of ink cartridge 20. To calculate when to "flip" a fine count bit value, print control procedure 35 reads both a drop volume parameter 54 (encoded on printhead memory 16) and an ink supply volume value 56 (encoded on cartridge memory 28). Print control procedure 35 then calculates how many drops are required too cause one fine count bit flip (i.e., an amount equal to 1/256 of 12.5% of the total supply volume). Then. by counting input signals fed to the heater resistors (as indicative of the cumulative number of emitted ink drops), print control procedure 35 knows when to increment the value in fine count value 52.

When ink cartridge 20 is first inserted, print control procedure 35 reads the manufacture day/year data 58 to determine the age of ink cartridge 20. Thereafter, the value of fine count entry 52 is adjusted to take into account evaporation assumptions.

A coarse count value 60 in cartridge memory 28 is incremented each time 12.5% of the ink in ink cartridge 20 is consumed. Coarse count value 60 is incremented each time fine count value 52 "rolls over". As will be hereafter understood, fine count value 52 and coarse count value 60 are both utilized to determine an amount of remaining ink in ink cartridge 20.

As indicated in FIG. 6, a drop usage calculation subprocedure 70 employs a number of values stored on both cartridge memory 28 and printhead memory 16 to calculate an amount of ink remaining in ink cartridge 20. Thus, drop usage calculation subprocedure 70 reads drop volume parameter 54 from printhead memory 16 and ink supply size parameter 56 from ink cartridge memory 28. Further, inputs from thermal sense resistors 76 (associated with print element 14 in FIG. 1) are also input to drop usage calculation subprocedure 70. From the drop volume parameter and thermal sense resistor inputs, the total volume of drops emitted are calculated and, using supply size parameter 56, subprocedure 70 calculates the remaining amount of ink available in cartridge 28. Upon arriving at such a calculated value, fine count value 52 is incremented to reflect the current ink usage state and, if a "roll-over" of the count is sensed, coarse count value 60 is also incremented. These calculations occur as printing takes place, with fine count value 52 and coarse count value 60 being incremented to reflect the volume of ink ejected by printhead 12. As drop usage calculation subprocedure 70 arrives at new values for fine count value 52 and coarse count value 60, such values are accordingly rewritten into cartridge memory 28 via data line 74.

Because ink supply cartridge sizes will vary, both drop volume parameter 54 and initial supply size parameter 56 are used in the calculation.

A drop volume parameter update subprocedure 75 is periodically run to account for changes in drop volume which occur as printhead 12 ages. Drop volume parameter update subprocedure 74 initially accesses drop volume parameter 54 from printhead memory 16. It then employs cumulative usage data to estimate the state of the printhead. That cumulative usage value is calculated by use of fine count value 52, coarse count value 60 from a current ink cartridge 20 and previous fine and coarse count values from now-replaced ink cartridges. That data is accumulated on printhead memory 16 in the form of a cumulative "number of drops fired" value 76. An algorithm for re-calculation of drop volume uses the following expressions:

$$Vcalc = Vmeas + \Delta Vtrans + \Delta Vtime + \Delta V\#drops + \Delta V(T) + \Delta V(f)$$
$$\Delta Vtime = k1t + k2t^2 + \ldots$$
$$\Delta V\#drops = c1N + c2N^2 + \ldots$$
$$\Delta V(T) = b1T + b2T^2 + \ldots$$
$$\Delta V(f) = d1f + d2f^2 + \ldots$$

where:

Vcalc=calculated drop volume

Vmeas=drop volume measured in the factory.

ΔVtrans=transient drop volume change (from surface wetting or burn-in).

ΔVtime=effect of time (long term) on drop volume k1, k2, . . . =constants t=time elapsed since printhead was manufactured Note: the constants are characterized and encoded at the printhead factory; the time t is calculated by the printer by comparing the computer clock to the date code on the printhead.

ΔV#drops=effect of firing on drop volume (long term—build up on resistor)

c1, c2, . . . =constants

N=number of drops fired since printhead was manufactured

ΔV(T)=effect of temperature b1, b2, . . . =constants

T=printhead temperature. It is calculated from a formula that relates the temperature to the TSR (thermal sense resistor) output; the TSR is monitored by the system to infer head temperature.

ΔV(f)=Effect of firing frequency d1, d2, . . . =constants

Note: Vtrans, k1, k2, d1, d2, c1, c2, b1, b2 are recorded at the factory; t is recorded on the printhead memory chip by the printer (by comparing a computer clock to the date code recorded on the ink cartridge memory); and N is recorded on the cartridge memory chip by the printer.

As the usage of printhead 12 increases, drop volume parameter update subprocedure 74 alters the drop volume parameter to track changes in the drop volume (e.g., as a result of ink build-up in the ink chambers and other factors). That drop volume parameter may then be rewritten to printhead memory 16 via data line 80.

Figure 7:
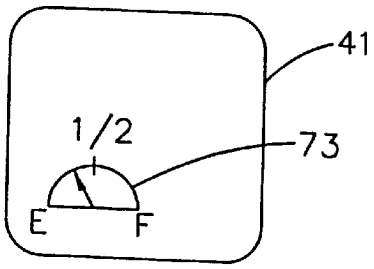
FIG. 7 is a schematic of a display used in the system of FIG. 1, illustrating a "gas gauge" to indicate the ink supply level in the ink cartridge of FIG. 2.

In order to provide the user with an indication of remaining ink in ink cartridge 20, drop usage calculations subprocedure 70 provides an output value to host processor 36 which implements a display procedure to cause monitor 40 to exhibit a "gas gauge" which is shown on monitor 41 in FIG. 7. Monitor 41 includes a gas gauge representation 73 in the lower left corner thereof. As the remaining ink quantity in ink cartridge 20 reduces, the indication of gas gauge 73 is altered accordingly.

A further subprocedure is periodically run each time a new media type is sensed by media sensor 30. As indicated above, media sensor 30 is enabled to detect a specific media type by invisible or visible indicia imprinted on the media and to provide a media type value to a dot density calculation subprocedure 82. In response, dot density calculation subprocedure 82 reads drop volume parameter 54 from printhead memory 16 and ink colorimetry parameter 84 from ink cartridge memory 28. Utilizing those two parameters, dot density calculation subprocedure 82 then calculates adjustments required for changes in dot density to achieve a correct hue and intensity on the sensed media type.

It should be understood that the foregoing description is only illustrative of the invention. Various alternatives and modifications can be devised by those skilled in the art without departing from the invention. While the above invention has been described in the context of an ink jet printer, those skilled in the art will realize that it is equally applicable to other printer/copier arrangements which employ replaceable units and wherein control procedures are dependent upon parameters read from multiple such replaceable units. Accordingly, the present invention is intended to embrace all such alternatives, modifications and variances which fall within the scope of the appended claims.

I claim:

1. A printing system comprising:

replaceable cartridge means for housing a supply of consumable marking media and including cartridge memory means for recording printer-related parameters, including marking media parameters;

replaceable print means for producing marks on a print media and including printhead memory means mounted thereon for recording print means-related parameters;

processor means coupled to said cartridge memory means and said printhead memory means and responsive to parameters read from both said cartridge memory means and said printhead memory means for deriving a printer function control value that is dependent upon at least a marking media parameter from said cartridge memory means and a print means-related parameter from said printhead memory means.

2. The printing system as recited in claim 1, wherein said replaceable cartridge means is an ink reservoir cartridge that is pluggably insertable into said printing system and said cartridge memory means forms an integral part of said cartridge and makes electrical connection to said printing system upon insertion of said cartridge.

3. The printing system as recited in claim 2, wherein said printing system control function value is a number of ink drops that are fired per count of an ink volume counting means.

4. The printing system as recited in claim 2, wherein said replaceable print means is an ink jet printhead that is pluggably insertable into said printing system and said printhead memory means forms an integral part of said ink jet printhead and makes electrical connection to said printing system upon insertion of said ink jet print head.

5. The printing system as recited in claim 4, further comprising:

sense means coupled to said ink jet printhead for producing signals indicative of mark production by said ink jet printhead, said processor means further employing data derived from said signals to arrive at said printing system control function value.

6. The printing system as recited in claim 5, wherein a parameter relating to current ink volume received by said processor from said cartridge memory means, a parameter relating to drop volume received from said printhead memory means and said data derived from said sense means, are combined by said processor means to adjust said parameter relating to current ink volume.

7. The printing system as recited in claim 6, wherein said processor means causes said parameter relating to current ink volume, that is adjusted, to be written back into said cartridge memory means.

8. The printing system as recited in claim 6, further comprising:

display means coupled to said processor means; and wherein said processor means is responsive to said value of current ink volume that is adjusted and a parameter from said cartridge memory means relating to cartridge supply ink volume, to provide a gauge indication on said display means which indicates an amount of ink remaining in said ink reservoir cartridge.

9. The printing system as recited in claim 4, further comprising;

media sense means for providing to said processor means a media type signal that is dependent upon a type of media sheet present in said printing system; and wherein said media type signal and a parameter read from said cartridge memory means are employed by said processor means to provide a control signal for adjusting dot density produced by said printing system.

10. A method for controlling operation of a printing system, wherein the printing system includes (i) a replaceable cartridge for housing a supply of consumable marking media, said cartridge further including a cartridge memory mounted thereon for recording printing system-related parameters, including marking media parameters and (ii) replaceable print means for producing marks on a print media and further including a print memory mounted thereon for recording print means-related parameters, the method comprising the steps of:

reading parameters stored on both said cartridge memory and said print memory; and deriving a printing system function control value that is dependent upon at least a marking media parameter read from said cartridge memory and a print means-related parameter read said print memory means.

11. The method as recited in claim 10, further comprising the steps of:

deriving signals from said print means indicative of mark production thereby; and employing data derived from said signals to arrive at said printing system control function value.

12. The method as recited in claim 10, further comprising the steps of:

sensing a media type signal that is dependent upon a type of media sheet present in said printing system; and combining said media type signal and a parameter relating to a marking media characteristic in said cartridge, received from said cartridge memory, to provide a control signal for adjusting dot density produced by said printing system.

13. The method as recited in claim 10, further comprising the steps of:

adjusting a parameter relating to current marking media volume in accord with said control signal; and writing said parameter that is adjusted back into said cartridge memory.

14. The method as recited in claim 10, further comprising the steps of:

displaying a gauge indication which indicates an amount of marking media remaining in said cartridge, said amount determined from said value of current marking media that is adjusted and a parameter from said cartridge memory relating to cartridge marking media ink volume.

15. A replaceable ink cartridge for an ink jet printing system, the printing system including a replaceable printhead for producing marks on a print media, the replaceable printhead having a printhead memory element mounted thereon for recording print means-related parameters, the printing system including a processor means that is coupled to the printhead memory element when the replaceable printhead is releasably coupled to the printing system, the replaceable ink cartridge comprising:

an ink reservoir containing an ink supply;

a discharge port in fluid communication with the ink reservoir, the discharge port establishing fluid communication with a fluid inlet in the ink station when the ink cartridge is releasably mounted to the receptacle; and a cartridge memory element mounted thereon and having cartridge-related parameters stored therein, the cartridge memory element electrically coupled with the processor means so that the processor means has access to the cartridge-related parameters when the ink cartridge is installed in the receptacle;

wherein, in order to carry out a printing operation where ink is transferred from the ink reservoir through the discharge port to the printhead, certain cartridge-related parameters stored in the cartridge memory element are stored and/or modified by signals from the processor means, and or transmitted from the ink cartridge to the processor means so that the processor means derives a printing system function control value that is dependent upon at least both a cartridge-related parameter and a printhead-related parameter when the replaceable print means and the replaceable ink cartridge are releasably installed in the ink jet printing system.

16. The replaceable ink cartridge of claim 15, wherein the cartridge-related parameters include factory parameters that are recorded at the time the ink cartridge is manufactured.

17. The replaceable ink cartridge of claim 16, wherein the cartridge factory parameters include the volume of the ink supply.

18. The replaceable ink cartridge of claim 16, wherein the printhead-related parameters include factory parameters that are recorded at the time the replaceable printhead is manufactured.

19. The replaceable ink cartridge of claim 18, wherein the factory parameters include a printhead drop volume.

20. A replaceable ink cartridge for an ink jet printing system, the printing system including a plurality of printheads of different colors for ejecting droplets of ink on media, each printhead including a printhead memory element mounted thereon and having printhead factory parameters stored therein, the printing system having a processor means for controlling printing system function, the processor means coupling with the printhead memory element so that the processor means has access to the printhead factory parameters, the printing system including an ink station for supplying ink to the printhead, the ink station including a plurality of receptacles corresponding to the plurality of printheads, the replaceable ink cartridge comprising:

a cartridge body having an ink reservoir therein, the cartridge body adapted to be releasably mounted to one of the plurality of receptacles in said ink jet printing system;

a discharge port in fluid communication with the ink reservoir, the discharge port establishing fluid communication with a fluid inlet in one of the plurality of receptacles when the cartridge body is releasably mounted to one of the plurality of receptacles to thereby enable ink to flow out of the discharge port and to an associated printhead when the cartridge body is releasably mounted to one of the plurality of receptacles; and an ink cartridge memory element mounted thereon and adapted to electrically couple to the processor means when the cartridge body is releasably mounted to one of the plurality of receptacles, the ink cartridge memory element thereby providing ink cartridge factory parameters to the processor means; and wherein, in order to carry out a printing operation where ink is transferred from the ink reservoir through the discharge port and to the printhead, certain factory-inserted parameters stored in the ink cartridge memory element are transmitted from the ink cartridge memory element to the processor means so that the processor means combines at least one ink cartridge factory-inserted parameter and at least one printhead factory-inserted parameter to derive a usage control parameter for the printhead.

21. The replaceable ink supply of claim 20, wherein the ink reservoir has a deliverable volume of ink and wherein the at least one ink cartridge factory parameter includes a value corresponding to the deliverable volume of ink.

22. The replaceable ink supply of claim 20, wherein the at least one printhead factory parameter includes a value corresponding to the drop volume of the printhead.

23. The replaceable ink supply of claim 20, wherein the ink reservoir has a usage life, and the processor means periodically calculates the usage control parameter during a usage life of the ink reservoir to provide an updated usage value, the processor means periodically writing the updated usage value to the ink cartridge memory element.

24. The replaceable ink supply of claim 23, wherein the processor means reads the usage control parameter from the ink cartridge memory element, the processor means combines at least one ink cartridge factory parameter, at least one printhead factory parameter, and the usage control parameter to calculate the updated usage control parameter.

* * * * *

UNITED STATES PATENT AND TRADEMARK OFFICE

CERTIFICATE OF CORRECTION

PATENT NO. : 5,812,156

DATED : September 22, 1998

INVENTOR(S) : Bullock et al.

It is certified that error appears in the above-identified patent and that said Letters Patent is hereby corrected as shown below:

At Column 8, beginning on line 39 and continuing through line 41, delete "said cartridge further including a cartridge memory mounted thereon for recording printing system-related parameters, including marking media parameters"

At Column 8, beginning on line 43 and continuing on line 44, delete "and further including a print memory mounted thereon for recording print means-related parameters";

At Column 8, line 46, before "reading", insert

--utilizing a cartridge memory which stores printed system related parameters and is mounted on said replaceable cartridge;

and further utilizing a print memory which stores print means-related parameters and is mounted on said replaceable printer means ;--.

Signed and Sealed this

Fifth Day of January, 1999

*Attest:*

*Attesting Officer*

*Acting Commissioner of Patents and Trademarks*